US009670052B2

(12) United States Patent
Worley et al.

(10) Patent No.: US 9,670,052 B2
(45) Date of Patent: Jun. 6, 2017

(54) FUEL DISPENSING NOZZLE HAVING ATTITUDE SENSING ARRANGEMENT

(71) Applicant: Veeder-Root Company, Simsbury, CT (US)

(72) Inventors: Brian Christopher Worley, Beavercreek, OH (US); Andres Deogracias Viduya, Hollidaysburg, PA (US); Niranjan Srinivasan, Hollidaysburg, PA (US)

(73) Assignee: Veeder-Root Company, Simsbury, CT (US)

( * ) Notice: Subject to any disclaimer, the term of this patent is extended or adjusted under 35 U.S.C. 154(b) by 25 days.

(21) Appl. No.: 14/869,485

(22) Filed: Sep. 29, 2015

(65) Prior Publication Data

US 2016/0096720 A1 Apr. 7, 2016

Related U.S. Application Data

(60) Provisional application No. 62/058,908, filed on Oct. 2, 2014.

(51) Int. Cl.
*B67D 7/54* (2010.01)
*B67D 7/04* (2010.01)
(Continued)

(52) U.S. Cl.
CPC ..... *B67D 7/54* (2013.01); *B67D 7/04* (2013.01); *B67D 7/362* (2013.01); *B67D 7/46* (2013.01);
(Continued)

(58) Field of Classification Search
CPC ..... B67D 7/52; B67D 7/54; B67D 7/0476; B67D 7/44
(Continued)

(56) References Cited

U.S. PATENT DOCUMENTS 3,323,560 A 6/1967 Ehlers
3,638,689 A 2/1972 Eklund
(Continued)

FOREIGN PATENT DOCUMENTS

WO 9221563 A1 12/1992
WO 2012071171 A1 5/2012

OTHER PUBLICATIONS

International Search Report and Written Opinion mailed on Jan. 7, 2016 in corresponding international application No. PCT/US2015/053256, all enclosed pages cited.

*Primary Examiner* — Timothy L Maust
*Assistant Examiner* — Timothy P Kelly
(74) *Attorney, Agent, or Firm* — Nelson Mullins Riley & Scarborough, LLP

(57) ABSTRACT

An attitude sensing arrangement for triggering a shutoff mechanism on a fuel dispensing nozzle comprising a rolling element placed inside a non-cylindrical chamber that is sealed with a plug such that the rolling element may move freely inside the chamber. A vacuum sensing path passes from a sensing port in the nozzle spout, through a vacuum sensing tube, into the non-cylindrical chamber, and into a venturi-generated vacuum chamber. The attitude sensing arrangement is configured such that the rolling element blocks a shutoff port in the non-cylindrical chamber when the nozzle is raised past a certain shutoff angle. When the vacuum sensing path is blocked by the rolling element in this manner, the shutoff mechanism closes the main fuel valve.

18 Claims, 5 Drawing Sheets

(51) Int. Cl.

| | |
|---|---|
| ***B67D 7/36*** | (2010.01) |
| ***B67D 7/46*** | (2010.01) |
| ***B67D 7/52*** | (2010.01) |
| *B67D 7/48* | (2010.01) |

(52) U.S. Cl.
CPC ..... *B67D 7/52* (2013.01); *B67D 7/0476* (2013.01); *B67D 7/48* (2013.01)

(58) Field of Classification Search
USPC ..... 141/206, 301
See application file for complete search history.

(56) References Cited

U.S. PATENT DOCUMENTS

| | | | | |
|---|---|---|---|---|
| 4,809,753 | A | 3/1989 | Fink, Jr. | |
| 5,273,087 | A * | 12/1993 | Koch | B67D 7/0482 116/273 |
| 7,134,580 | B2 | 11/2006 | Garrison et al. | |
| 8,616,252 | B2 | 12/2013 | Clever et al. | |
| 2011/0272063 | A1* | 11/2011 | Tumarkin | B67D 7/42 141/387 |
| 2012/0125478 | A1* | 5/2012 | Clever | B67D 7/44 141/1 |

* cited by examiner

FUEL DISPENSING NOZZLE HAVING ATTITUDE SENSING ARRANGEMENT

PRIORITY CLAIM

This application is based upon and claims the benefit of U.S. provisional application Ser. No. 62/058,908, filed Oct. 2, 2014. The foregoing application is incorporated fully herein by reference.

FIELD OF THE INVENTION

The present invention relates generally to the art of fuel dispenser nozzles. More particularly, it relates to a fuel dispenser nozzle having an attitude sensing arrangement that triggers a valve shutoff mechanism when certain conditions are detected.

BACKGROUND

Fuel dispensing facilities are in widespread use, providing customers with liquid fuel for various applications. A common fueling transaction, where fuel is dispensed into a vehicle fuel tank, typically proceeds as follows: The customer indicates to the fuel dispenser the type of fuel desired and a payment method. The fuel dispenser authorizes payment and energizes a pump which pumps fuel to the nozzle. The customer places the nozzle into the vehicle fuel tank and pulls the handle of the nozzle to open a valve and dispense the desired amount of fuel.

Fuel dispensing nozzles are often equipped with shutoff mechanisms to stop the flow of fuel if certain trigger conditions occur, such as when the vehicle fuel tank is full. These shutoff mechanisms are meant to prevent fuel spillage. The shutoff mechanism may be associated with an attitude sensing device which is configured to trigger the shutoff mechanism and stop the flow of fuel when the nozzle is angled at or above horizontal—an orientation likely achieved, for example, when the nozzle is removed from the tank while dispensing.

However, current attitude sensing devices frequently trigger the shutoff mechanism when the trigger conditions are not actually present. These unintended valve shutoffs—i.e., nuisance trips—occur for a variety of reasons, one of which is an overly sensitive or faulty attitude sensing device. Therefore, it is desirable to have an attitude sensing device that reliably and predictably triggers the shutoff mechanism when the trigger conditions occur, but minimizes or eliminates the number of unintended nuisance trips.

SUMMARY

The present invention recognizes the foregoing, and other, considerations of the prior art.

One aspect of the present invention provides a fuel dispensing nozzle comprising a dispensing path configured to dispense fuel, a vacuum sensing path configured to have a negative pressure when fuel is flowing through the dispensing path, and an attitude sensing arrangement that is located along the vacuum sensing path. The attitude sensing arrangement comprises a movable element located inside a non-cylindrical chamber with a surface that tapers toward a shutoff port. The dispensing path of the nozzle is closed when the movable element engages the shutoff port.

In some example embodiments of the present invention, the movable element is a spherical ball and the shutoff port comprises a ball valve seat. The non-cylindrical chamber may be arcuate and the tapered surface of the non-cylindrical chamber may be formed such that the rolling element rolls toward the shutoff port when the nozzle is held at an angle at or above horizontal. The non-cylindrical chamber may be connected to the vacuum sensing path through a vacuum port that connects a sensing tube that is connected to a sensing port near the tip of the nozzle spout, and the vacuum port may be offset from the center of the non-cylindrical chamber.

Another aspect of the present invention contemplates an attitude sensing arrangement comprising a spout housing defining a fuel delivery path and a vacuum sensing path and a plug configured to be received in the spout housing. The spout housing and plug may define a sensing chamber within which a rolling element may move freely, and the plug may define a vacuum port for connecting a vacuum sensing tube from the nozzle spout. The sensing chamber may be non-cylindrical in cross-section and taper toward a blocking position that actuates a shutoff mechanism when the nozzle is raised past a shutoff angle.

Furthermore, the sensing chamber may define a valve seat and the rolling element may block the vacuum sensing path by engaging the valve seat. The sensing chamber may be arcuate and the vacuum port may be offset from the center of the sensing chamber. The shutoff mechanism can be configured such that the shutoff angle is any angle where the nozzle is at or above horizontal.

Still another aspect of the present invention provides a method for operating a nozzle with an attitude sensing arrangement, comprising steps of: holding the nozzle at an angle sufficient to cause a rolling element in a sensing chamber to roll away from a valve seat, wherein the sensing chamber has a non-cylindrical cross-section and a vacuum sensing path passing through. The method further comprises opening a fuel flow valve in the nozzle to allow fuel to flow through the nozzle spout, wherein the flowing fuel creates a vacuum in the vacuum sensing path and the sensing chamber. Finally, the method comprises raising the nozzle to an angle sufficient to allow gravitational and suction forces to cause the rolling element to roll toward and engage the valve seat, thus blocking the vacuum sensing path and actuating a mechanism to shut off the fuel flow valve.

BRIEF DESCRIPTION OF THE DRAWINGS

A full and enabling disclosure of the present invention, including the best mode thereof directed to one of ordinary skill in the art, is set forth in the specification, which makes reference to the appended drawings, in which.

Figure 1:
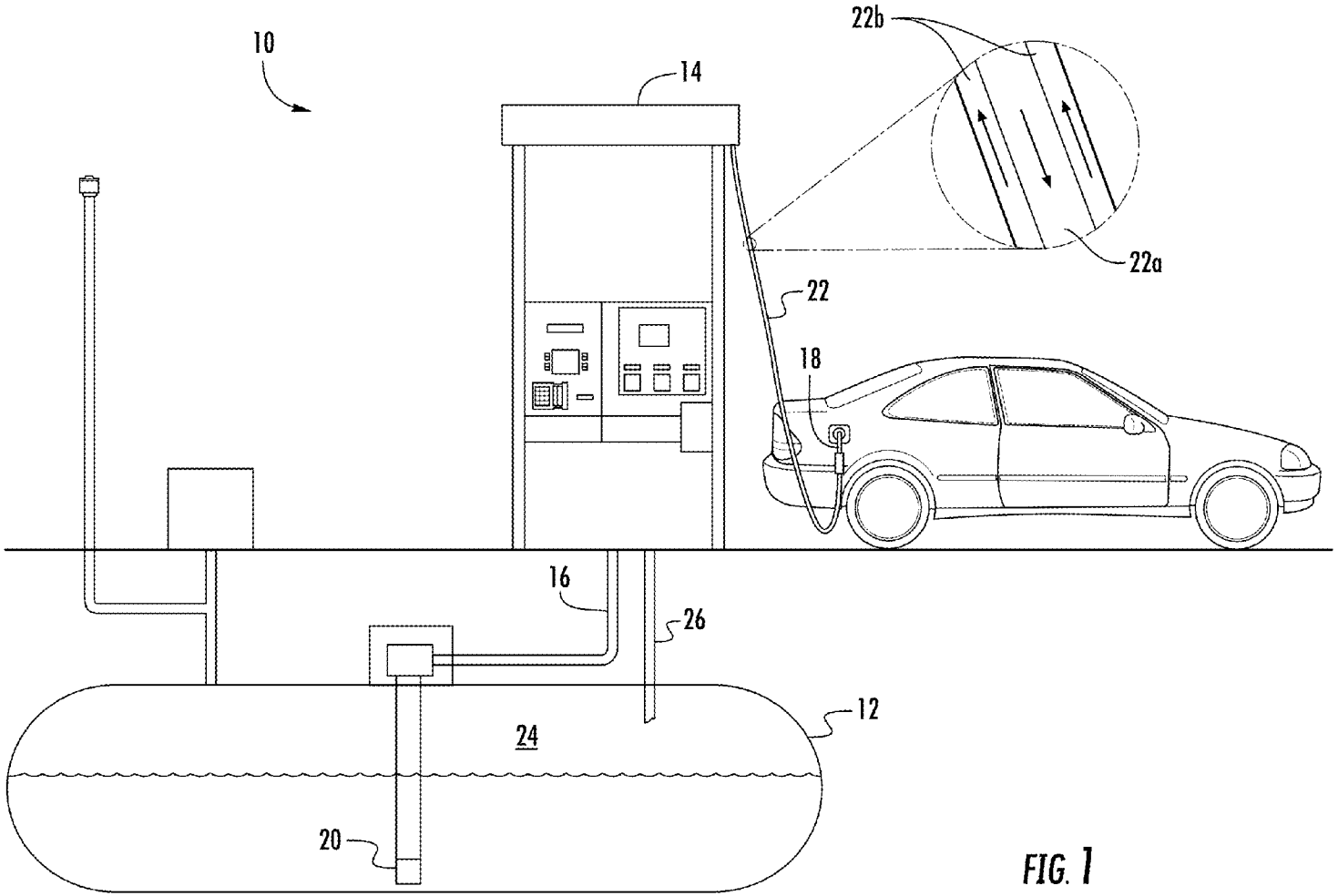
FIG. 1 shows a schematic diagram of a fuel dispensing facility where example embodiments of the present invention may be implemented.

Repeat use of reference characters in the present specification and drawings is intended to represent same or analogous features or elements of the invention.

DETAILED DESCRIPTION OF THE PREFERRED EMBODIMENTS

Reference will now be made in detail to presently preferred embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations.

FIG. 1 is a schematic diagram of a fuel dispensing facility 10 where exemplary embodiments of the present invention may be implemented. At such facilities, fuel is stored in underground storage tanks (USTs) 12 which are in fluid communication with one or more fuel dispensers 14 via underground piping conduit 16. When a customer places the spout of the fuel dispensing nozzle 18 into the vehicle's fuel tank and pulls the lever, a submersible turbine pump (STP) 20 pumps fuel through the underground fuel piping conduit 16 to the fuel dispenser 14. The fuel is then delivered into the vehicle's fuel tank through the inner conduit 22*a* of coaxial fuel hose 22 and nozzle 18. In other embodiments, a pumping unit may be located in the fuel dispenser to draw fuel from UST 12.

As the vehicle fuel tank is filled, entering fuel displaces fuel vapor already in the tank. Fuel dispensers are often equipped with vapor recovery systems for capturing these escaping vapors and delivering them back to the ullage space 24 of the UST 12. Exemplary vapor recovery systems often use a vacuum source to draw escaping vapors along a vapor return path back into the ullage space 24. The required vacuum is generally achieved by a vapor recovery pump or other suction source, often located in the fuel dispenser itself, which is in fluid communication with the vapor return path to create a vacuum which facilitates collection of the fuel vapors. Alternatively, some vapor recovery systems draw in vapors by using pressure differentials inherently created in the fuel system when fuel is dispensed and the fuel level in the UST 12 drops.

The vapor recovery path typically begins at the nozzle spout, where air and vapor are drawn in through a boot 30 (see FIG. 2) or a series of intake ports. The recovered vapors then flow through the nozzle to the outer vapor recovery conduit 22*b* of the fuel hose 22. Inside the fuel dispenser 14, a manifold (not shown) separates conduits 22*a* and 22*b* and connects them with piping 16 and 26, respectively. Specifically, fuel conduit 22*a* is in fluid communication with underground piping conduit 16. Vapor recovery conduit 22*b* is in fluid communication with vapor return pipe 26, which returns the recovered vapors back into the ullage space 24 of the UST 12.

Figure 2:
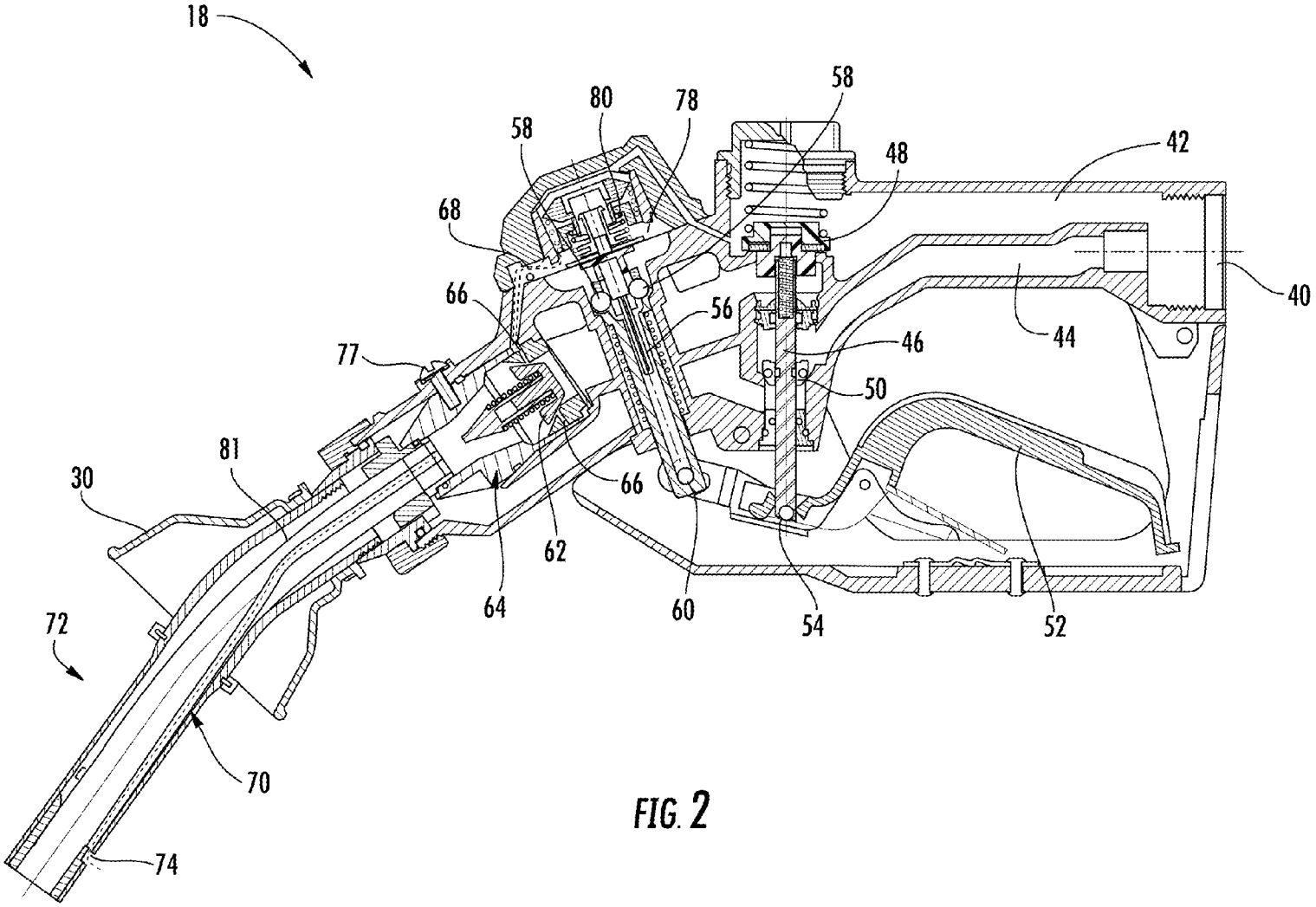
FIG. 2 shows a cross-sectional view of a fuel dispensing nozzle configured to implement an attitude sensing arrangement in accordance with an embodiment of the present invention.
Figure 3:
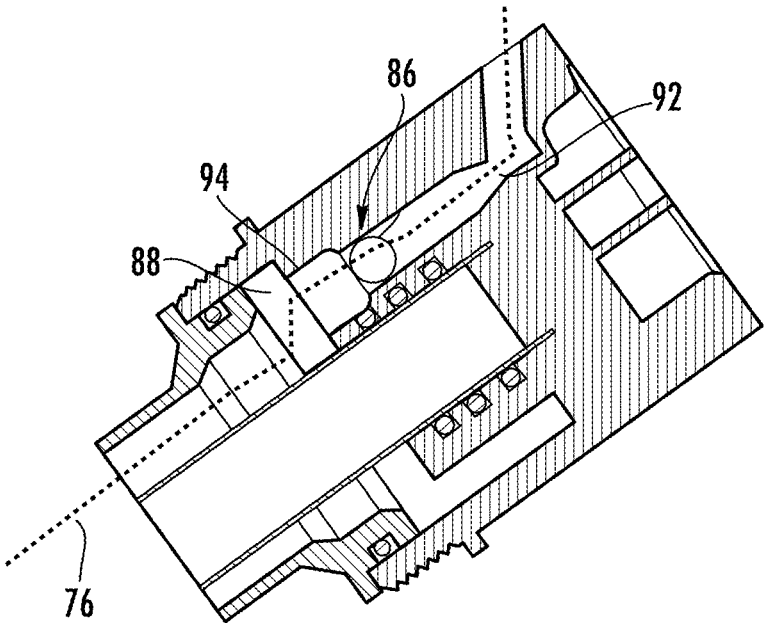
FIG. 3 shows a cross-sectional view of a spout housing comprising an attitude sensing arrangement in accordance with an example embodiment of the present invention.
Figure 4:
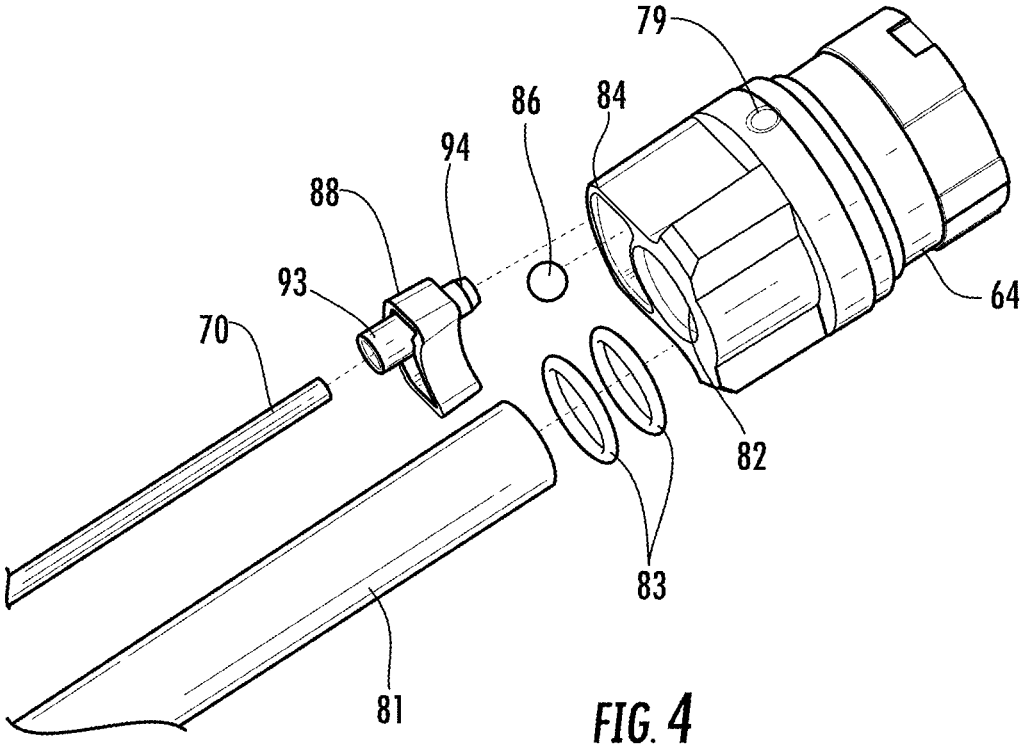
FIG. 4 shows a perspective exploded view of a spout housing comprising an attitude sensing arrangement in accordance with an example embodiment of the present invention.
Figure 5:
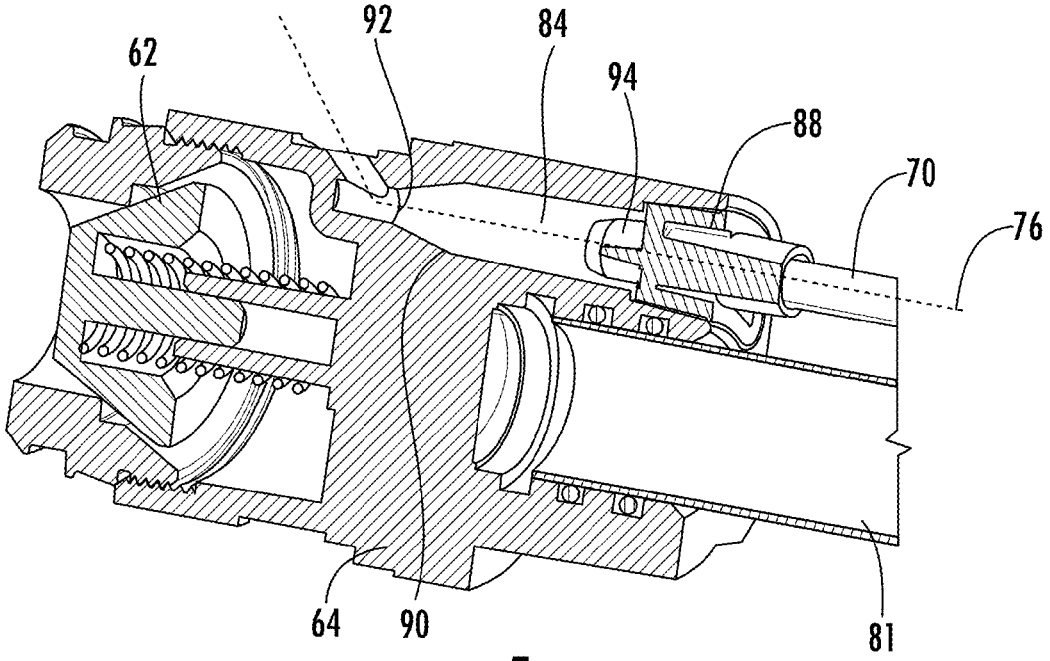
FIG. 5 shows a perspective cross-sectional view taken along line 5-5 of FIG. 6.
Figure 6:
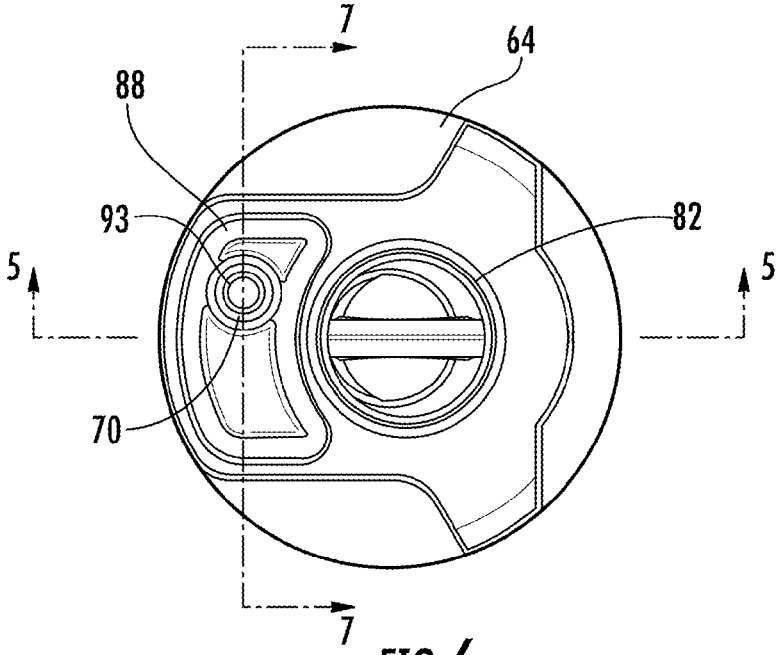
FIG. 6 shows an end view of a spout housing comprising an attitude sensing arrangement in accordance with an example embodiment of the present invention.

FIG. 2 shows a cross-sectional view of a fuel dispensing nozzle 18 configured to implement an attitude sensing arrangement in accordance with an embodiment of the present invention. The nozzle 18 has an inlet port 40 that receives the coaxial fuel hose 22 such that the inner conduit 22*a* is in fluid communication with the main fluid path 42 and the outer conduit 22*b* is in fluid communication with the vapor recovery line 44. The main valve stem 46 is configured to open and close a main fluid valve 48 and a main vapor recovery valve 50.

The main valve stem 46 is spring-biased in a closed position—i.e., downward—and is pivotally connected to the lever arm 52 at the intermediate pivot 54. During a normal dispensing event, plunger 56 of the nozzle's shut-off mechanism is locked in a retracted position by metallic balls 58. As a result, plunger pin 60 acts as a fulcrum for lever arm 52. Therefore, when a customer pulls up on lever arm 52, main valve stem 46 simultaneously opens both the main fluid valve 48 and the main vapor recovery valve 50. This allows fuel to flow through the main fluid path 42.

The flowing fuel creates sufficient pressure to open poppet valve 62 and allow fuel to flow through the spout housing 64. As fuel flows through the poppet valve 62 and past venturi channels 66, a vacuum is created in the venturi-generated vacuum chamber 68. The vacuum chamber 68 is connected to a vacuum sensing tube 70 that extends to the tip of the nozzle spout 72. The vacuum sensing tube 70 draws in air and vapor through a sensing port 74 near the tip of the nozzle spout 72 as the fuel flows out of the nozzle 18. Although the preferred embodiment contemplates the use of a venturi as the mechanism creating a vacuum in the vacuum sensing chamber 68, the attitude sensing arrangement is not so limited and other suitable methods for creating a vacuum may be used.

Fuel dispensing nozzles often have shutoff mechanisms configured to close the fuel dispensing and vapor recovery valves when certain conditions occur. These shutoff mechanisms often rely on changes in the vacuum generated in the venturi-generated vacuum chamber 68 as a trigger. As explained by reference to FIG. 2, the shutoff mechanism operates by releasing the main valve stem 46—and thus closing the main fluid valve 48 and main vapor recovery valve 50—when the vacuum sensing path is blocked. Typically, this mechanism operates by using an arrangement comprising diaphragm 78, metallic balls 58, and plunger 56. When the pressure drops in the venturi-generated vacuum chamber 68, the diaphragm 78 pops up against the force of spring 80 and allows the metallic balls 58 to retract from receiving notches in the plunger 56. The plunger 56 is spring-biased so that when the metallic balls 58 are removed, the plunger 56 is driven downward, thus releasing the plunger pin 60 and lowering the fulcrum point of lever 52. Once the plunger pin 60 is released, the spring on the spring-biased main valve stem 46 closes the main fluid valve 48 and main vapor recovery valve 50.

The shutoff mechanism can be configured to be triggered when various conditions occur. For example, the shutoff mechanism is primarily intended to stop the flow of fuel when the vehicle's fuel tank is full. Specifically, when the fuel level in the tank reaches the tip of the nozzle 18, it blocks the sensing port 74 of the vacuum sensing tube 70 and causes the shutoff mechanism to stop the flow of fuel as described in the previous paragraph. Furthermore, in accordance with an example embodiment of the present invention, and as discussed in detail below, an attitude sensing arrangement may serve as a trigger for the fuel valve shutoff mechanism.

In an exemplary embodiment, aspects of the attitude sensing arrangement are incorporated into the spout housing 64. Thus, referring now to FIGS. 3-8, embodiments of the spout housing and attitude sensing arrangement in accordance with aspects of the present invention will be described. In general, the spout housing 64 connects the main body of the nozzle 18 to the nozzle spout 72. In this regard, the spout housing 64 may be received in a configured pocket defined in the nozzle's main body. As shown in the drawings, the spout housing 64 may be retained in the pocket via one or more retaining screws 77. Screws 77 may engage a threaded hole 79 defined in the outer surface of spout housing 64.

Spout housing 64 connects the main fluid path 42 to the fuel output tube 81 and connects the vacuum sensing tube 70 with the venturi-generated vacuum chamber 68. The path of the vacuum is referred to generally as the vacuum sensing path 76. In this embodiment, the fuel tube 81 is press fit into a downstream aperture 82 defined in spout housing 64. One or more O-rings 83 may be located about fuel tube 81 inside of aperture 82 in order to seal this interface.

The spout housing 64 further defines a non-cylindrical chamber 84 through which the vacuum sensing path 76 is routed. A movable element—e.g., a spherical ball 86—is placed inside the chamber 84 and the chamber 84 is closed with a plug 88. The plug 88 retains the spherical ball 86 such that it is freely movable inside the chamber 84. The non-cylindrical chamber 84 may be, for example, kidney-shaped, although other non-cylindrical shapes are also contemplated and are within the scope of the present invention. In particular, chamber 84 has an arcuate configuration such that it extends around an arc segment of aperture 82. In addition, chamber 84 is located beside aperture 82 such that the attitude sensing arrangement is lateral to (rather than above or below) the fuel flow path. As will be described, such a configuration lessens unintended nuisance trips. The lateral sidewalls of chamber 88 are spaced slightly greater than the diameter of ball 86. The upper and lower surfaces of chamber 88 are tapered toward valve seat 92.

Spherical ball 86 thus rolls on the tapered surface 90 toward and away from valve seat 92. At the end of the tapered surface 90, the vacuum sensing path 76 is routed through a shutoff port, configured as a ball valve seat 92 in the exemplary embodiments of FIGS. 3-8. The plug 88 also has a port 93 for receiving the vacuum sensing tube 70 and communicating air and vapor flow through the chamber 84. In the example embodiment, the port 93 is offset from the center of the chamber 84 such that its center line is parallel to but above that of valve seat 92 when both are horizontal. A ferrule 94 aligned with port 93 extends into chamber 84 as shown.

During fuel dispensing operation the air enters into the nozzle 18 through the sensing port 74 and flows through the vacuum sensing tube 70, through offset port 93 into chamber 84, and out of the ball valve seat 92 into the venturi-generated venturi channel 66. As long as air continues to flow through the chamber 84 into the venturi-generated venturi channel 66, the diaphragm 78 remains in its relaxed position. If the air flow stops, such that the vacuum in the venturi-generated vacuum chamber 68 spikes, the diaphragm 78 pops up against the force of the spring 80, thus releasing metallic balls 58 and triggering the shutoff mechanism as described above.

Figure 7:
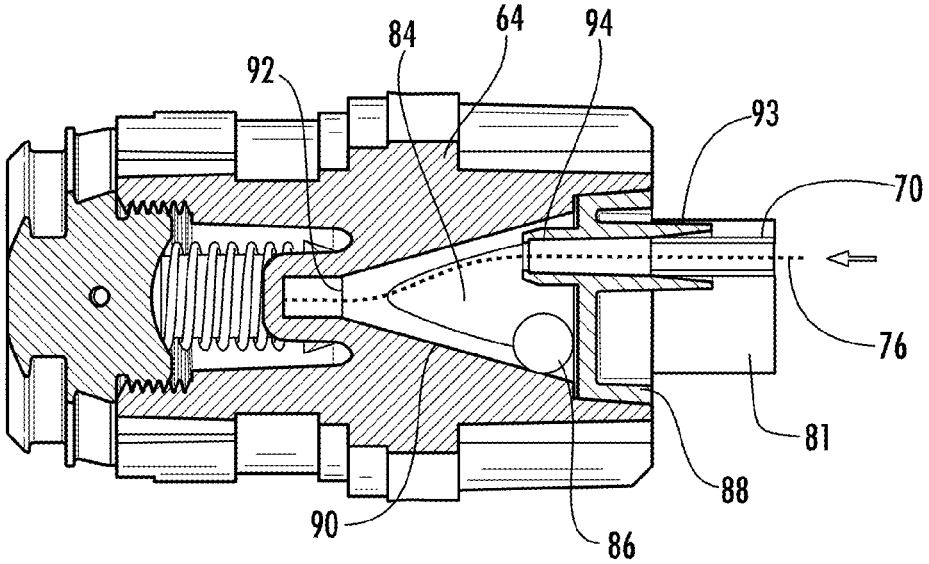
FIG. 7 shows a cross-sectional view taken along line 7-7 of FIG. 6, where the nozzle is positioned such that the rolling element does not impede the vacuum sensing path.

During a dispensing event, the spherical ball 86 moves freely within the chamber 84 according to the orientation of nozzle 18. If the nozzle 18 is oriented generally downward—e.g., when positioned in the fuel tank—gravity causes the spherical ball 86 to roll down the tapered surface 90 of the chamber 84 to a position where it does not impede the flow of air and vapor (as shown in FIG. 7). In this case, ball 86 rests against the inside surface of plug 88 below ferrule 94. This configuration prevents the spherical ball 86 from being entrained in the vacuum sensing path 76 or being elevated by eddy currents created in the chamber 84, which could otherwise cause the vacuum sensing path 76 to become blocked, leading to unintentional shut off—i.e., nuisance trips.

Figure 8:
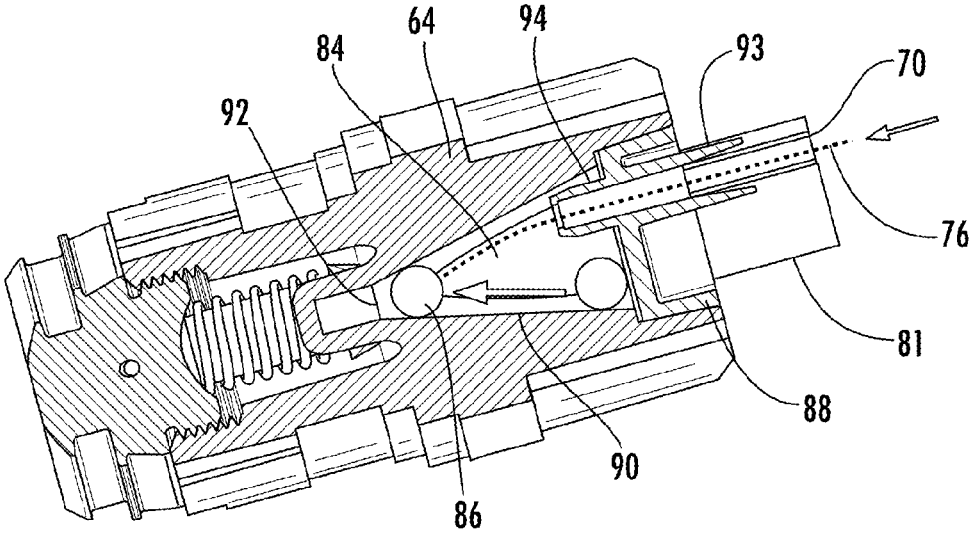
FIG. 8 shows a cross-sectional view similar to FIG. 7, where the nozzle is positioned such that the rolling element blocks the vacuum sensing path and thus triggers the shutoff mechanism.

By contrast, if the nozzle 18 is removed from the fuel tank while dispensing fuel (for example, to place the nozzle in the nozzle boot of the dispenser), the raised angle of the nozzle 18 will cause the spherical ball 86 to roll along the tapered surface 90 of the chamber 84 toward the ball valve seat 92 (see FIG. 8). The force of gravity, as well as the force of the airflow, causes the spherical ball 86 to engage the ball valve seat 92. When the spherical ball 86 becomes seated in the ball valve seat 92, the vacuum sensing path 76 is blocked and the shutoff mechanism closes the main valves. The same phenomenon prevents the nozzle from dispensing fuel when the lever is actuated on an energized nozzle when the nozzle is held at or above horizontal position—e.g., before insertion into the fuel tank.

In the example embodiment discussed above, the shutoff port is configured as a ball valve seat that is sealed by a spherical ball. However, one skilled in the art will understand that alternative shutoff ports are possible, and that a ball seat valve is used for explanatory purposes only. Furthermore, although the above paragraphs refer to a spherical ball, the present invention also contemplates any rolling or otherwise movable element that is sufficient to trigger the shutoff port, for example, by blocking the airflow in the chamber.

A benefit of a non-cylindrical—e.g., kidney-shaped—chamber is that the spherical ball may rest away and below the flow path even when the nozzle is oriented in a different angle during a dispensing event. This eliminates unintentional shut off.

Although the invention has been described using preferred embodiments, configurations, and components, any combinations of these features are included within the scope of the invention. Moreover, variations and modifications as would be recognized by those skilled in the art are within the scope of the present invention. Explanation is by way of example only and the disclosure is not meant to be limiting.

The invention claimed is:

1. A fuel dispensing nozzle comprising:

a dispensing path configured to dispense fuel;

a vacuum sensing path configured to have a negative pressure when fuel is flowing through the dispensing path; and an attitude sensing assembly that is located along the vacuum sensing path and comprises a movable element located inside a non-cylindrical chamber with a surface that tapers toward a shutoff port, wherein the dispensing path of the nozzle is closed when the movable element engages the shutoff port, and the non-cylindrical chamber is arcuate.

2. The fuel dispensing nozzle of claim 1, wherein the movable element is a spherical ball and the shutoff port comprises a ball valve seat.

3. The fuel dispensing nozzle of claim 1, wherein the tapered surface of the non-cylindrical chamber is formed such that the rolling element rolls toward the shutoff port when the nozzle is at an angle at or above horizontal.

4. The fuel dispensing nozzle of claim 1, wherein the non-cylindrical chamber is connected to the vacuum sensing path through a vacuum port that connects a sensing tube that is connected to a sensing port near the tip of the nozzle spout.

5. The fuel dispensing nozzle of claim 4, wherein the vacuum port is offset from the center of the non-cylindrical chamber.

6. The fuel dispensing nozzle of claim 1, wherein the non-cylindrical chamber is located lateral to the dispensing path.

7. The fuel dispensing nozzle of claim 1, wherein a lateral width of the non-cylindrical chamber is substantially equal to a diameter of the movable element.

8. The fuel dispensing nozzle of claim 1, wherein a lower wall of the non-cylindrical chamber is tapered toward the shutoff port.

9. The fuel dispensing nozzle of claim 8, wherein an upper wall of the non-cylindrical chamber is also tapered toward the shutoff port.

10. An attitude sensing arrangement comprising:

a spout housing defining a fuel delivery path and a vacuum sensing path;

a plug configured to be received in the spout housing, the spout housing and plug defining a sensing chamber within which a rolling element may move freely, and the plug defining a vacuum port for connecting a vacuum sensing tube from a nozzle spout, wherein the sensing chamber is non-cylindrical in cross-section and tapers toward a blocking position that actuates a shutoff mechanism when the nozzle spout is raised past a shutoff angle, and the non-cylindrical chamber is arcuate.

11. The attitude sensing arrangement of claim 10, wherein the sensing chamber defines a valve seat and the rolling element blocks the vacuum sensing path by engaging the valve seat.

12. The attitude sensing arrangement of claim 10, wherein the vacuum port is offset from a center of the sensing chamber.

13. The attitude sensing arrangement of claim 10, wherein the shutoff angle is any angle where the nozzle spout is at or above horizontal.

14. The attitude sensing arrangement of claim 10, wherein the sensing chamber is located lateral to the fuel delivery path.

15. The attitude sensing arrangement of claim 10, wherein a lateral width of the sensing chamber is substantially equal to a diameter of the rolling element.

16. The attitude sensing arrangement of claim 10, wherein a lower wall of the sensing chamber is tapered toward the blocking position.

17. The attitude sensing arrangement of claim 16, wherein an upper wall of the sensing chamber is also tapered toward the blocking position.

18. A method for operating a nozzle with an attitude sensing arrangement, comprising steps of:

holding the nozzle at an angle sufficient to cause a rolling element in a sensing chamber to roll away from a valve seat, wherein the sensing chamber has a non-cylindrical cross-section and a vacuum sensing path passing through, and the sensing chamber is arcuate;

opening a fuel flow valve in the nozzle to allow fuel to flow through the nozzle spout, wherein the flowing fuel creates a vacuum in the vacuum sensing path and the sensing chamber; and raising the nozzle to an angle sufficient to allow gravitational and suction forces to cause the rolling element to roll toward and engage the valve seat, thus blocking the vacuum sensing path and actuating a mechanism to shut off the fuel flow valve.

* * * * *